US005636481A

United States Patent [19]

De Zen

[11] Patent Number: 5,636,481

[45] Date of Patent: Jun. 10, 1997

[54] MOLDED CLADDING FOR BUILDING STRUCTURES

[75] Inventor: Vittorio De Zen, Woodbridge, Canada

[73] Assignee: Royal Building Systems (CDN) Limited, Woodbridge, Canada

[21] Appl. No.: 495,657

[22] PCT Filed: Feb. 2, 1994

[86] PCT No.: PCT/CA94/00052

§ 371 Date: Jul. 27, 1995

§ 102(e) Date: Jul. 27, 1995

[87] PCT Pub. No.: WO94/18412

PCT Pub. Date: Aug. 18, 1994

[30] Foreign Application Priority Data

Feb. 2, 1995 [CA] Canada ..... 2089025

[51] Int. Cl.[6] ..... E04D 1/30

[52] U.S. Cl. ..... 52/95; 52/555; 52/539; 52/522

[58] Field of Search ..... 52/95, 96, 522, 52/528, 536, 539, 555, 529, 533

[56] References Cited

U.S. PATENT DOCUMENTS

| | | | |
|---|---|---|---|
| 322,150 | 11/1885 | Besse . | |
| 2,991,592 | 7/1961 | Rauen | 52/539 X |
| 3,969,866 | 7/1976 | Kyne | 52/539 X |
| 4,040,211 | 8/1977 | Wotherspoon | 52/555 X |
| 4,680,911 | 7/1987 | Davis et al. | 52/539 X |
| 5,022,207 | 6/1991 | Hartnett | 52/528 X |
| 5,048,255 | 9/1991 | Gonzales | 52/533 |
| 5,305,570 | 4/1994 | Rodriquez et al. | 52/539 X |

FOREIGN PATENT DOCUMENTS

| | | |
|---|---|---|
| 643896 | 11/1930 | Belgium . |
| 0381339 | 1/1990 | European Pat. Off. . |
| 0394150 | 4/1990 | European Pat. Off. . |
| 693652 | 6/1964 | France . |
| 1376402 | 12/1964 | France . |
| 2551123 | 8/1984 | France . |
| 2146363 | 9/1971 | Germany . |
| 1042934 | 9/1966 | United Kingdom . |
| PCT/GB92/00457 | 10/1992 | WIPO . |

*Primary Examiner*—Carl D. Friedman
*Assistant Examiner*—Winnie Yip

[57] ABSTRACT

A molded cladded panel comprises on the underside thereof a bearing surface formation for bearing on an underlying support surface and latches for latching the panel to an underlying support surface, the panel having a profile configured to provide a desired appearance rising above the bearing surface formation, a nib formed on the profile for interfitting with adjoining panels whether in end-to-end or side-by-side relation, and a latched keeper member for latching engagement with the panel latches.

23 Claims, 11 Drawing Sheets

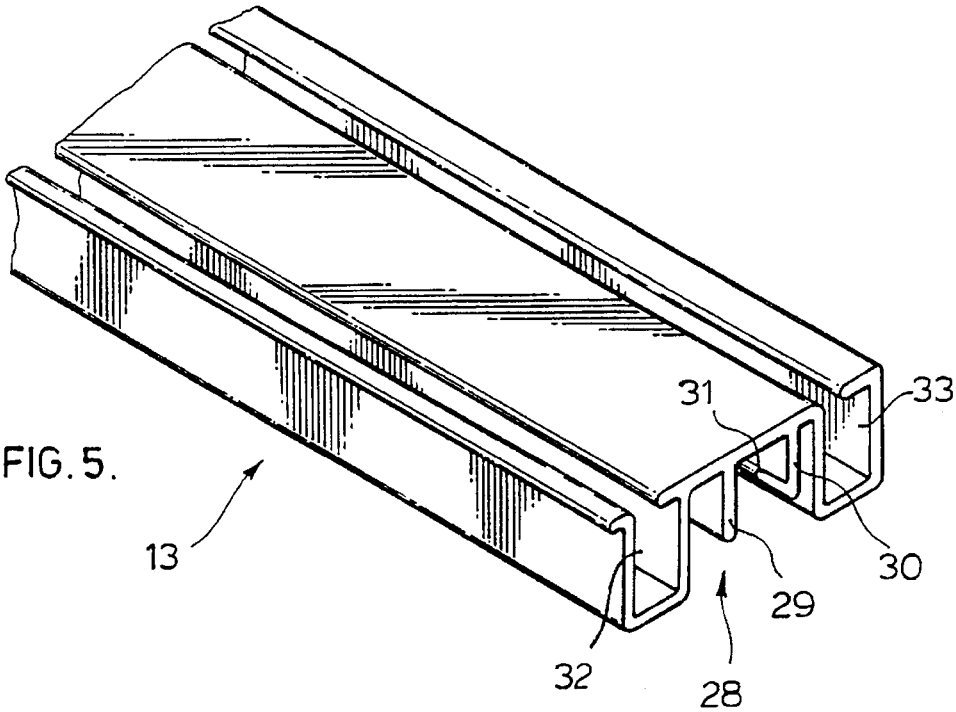
FIG. 5.
FIG. 6.
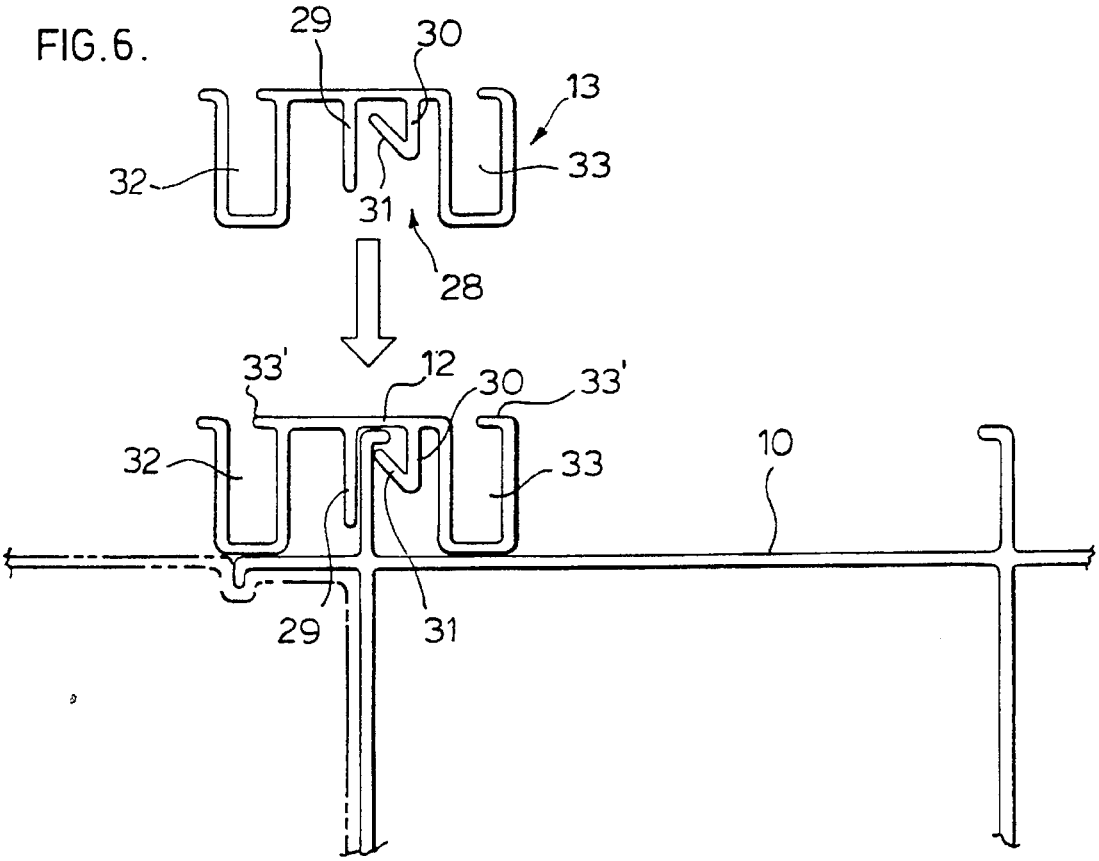

16'
25'
24'
25'
13
33
30
31
29
32

MOLDED CLADDING FOR BUILDING STRUCTURES

FIELD OF THE INVENTION

The present invention relates to cladding for use in housing and other building structures. More particularly, the invention provides a novel low cost, endurable cladding particularly adapted for the roofing of houses and other buildings not only to provide an enhanced appearance to the roof and building but also providing important functional advantages to protect the roof from the elements.

In this connection, the novel cladding of the present invention has particular application to the cladding of the roofs of housing and other building structures erected utilizing the building system and components therefor as disclosed and claimed in my copending U.S. application Ser. No. 08/338,605 which for the first time enables the erection of permanent, affordable, high quality housing and other building structures essentially totally from polymeric components which can be easily and rapidly assembled essentially without the use of tools to provide an essentially indestructible maintenance free structure.

In particular, the structural components of the said novel building system comprise extruded thermoplastic components with structural load bearing members incorporating a reinforcing constituent imparting structural strength and expansion control thereto and flowable with the thermoplastic material through an extrusion die to produce an integral, essentially rigid structural shape configured to present means for interconnection with adjoining structural components.

Such components include extruded rectilinear hollow panels and beams having internal cells and hollow box connectors extruded to have a thermoplastic core or substrate having reinforcing and expansion controlling material distributed therethrough and a coextruded smooth thermoplastic skin on the exposed exterior surfaces of said core. As disclosed in said copending application, particularly advantageous reinforcing material for incorporation and distribution throughout the core substrate consisting of vinyl chloride, eg. a polyvinyl chloride, comprises fine, short glass fibers with the said skin embedding and interlocking with the glass fiber portions that are exposed at the surface between the reinforced core and co-extruded skin.

A suitable glass fiber containing core material providing structural strength and expansion control may be obtained from B. F. Goodrich Company of Akron, Ohio, such material being described in detail in B. F. Goodrich's U.S. Pat. No. 4,536,360.

The coextruded skin may, for example, be PVC, rigid PVC, semi-rigid PVS, or ABS. Suitable skin thermoplastics are available from G.E. under the trade-marks "GELOY" or "NORYL".

According to the present invention, the cladding is provided by the assembly of a plurality of injection molded mating panels configured to interfit with each other and each having latch means at the underside thereof for latching same to an underlying cooperative latching means or keeper.

Further, accordingly to the invention, each panel member is formed at the underside thereof with spaced bearing surface or points for beating on an underlying support when the panel is latched to the underlying keeper, said panel member having a profile spanning said spaced bearing surfaces or points and having a profile rising thereabove and configured to provide a desired ascetic appearance.

Further, according to the invention, the panels by virtue of their said profile are adapted when interfitted to provide airflow channels for air circulation therebeneath. In this connection, the invention further contemplates the provision of screening to interfit with the panels at the ends of the airflow channels to block the entrance thereto of birds, insects, sleet, snow or the like.

A particular application of the invention as described herein is the provision of panels simulating roofing dies, for example, Spanish Roofing tiles, to form tiled roofing for thermoplastic housing or other building structures erected using the novel building system and thermoplastic components disclosed in my said copending U.S. application Ser. No. 08/338,605 as discussed above.

Plastic roof tiles fasten to battens have been disclosed. For instance, Belgian Patent BE-A-643896 (Schmidt) dated Mar. 13, 1964 discloses a plastic roof file having a hook at its underside at end thereof to engage spaced roof battens by sliding the tile longitudinally towards the battens.

According to the present invention, a molded cladding panel having a desired profile is provided with a plurality of latches on the underside thereof characterized in that each of the said latches comprises a depending tongue portion (24) having an integral barb (25) extending upwardly of the lower end of the tongue portion at an acute angle thereto, the barb being resiliently compressible towards the tongue portion to enable same to pass through the entrance of a keeper (13) and thereafter spring back away from the tongue portion within the keeper.

BRIEF DESCRIPTION OF THE DRAWINGS

The invention will be more fully understood with reference to the accompanying drawings illustrating representative embodiments of the invention and in which:

FIG. 5 is a broken away perspective view of a preferred form of adapter for connecting the roof tile panels to a roof structure such as illustrated in FIG. 2;

FIG. 6 is an end elevational view illustrating how the adapter of FIG. 5 is constructed to interlock with a box connector used in joining the roof panels of the roofing structure illustrated in FIG. 2;

DETAILED DESCRIPTION ACCORDING TO THE PREFERRED EMBODIMENTS

Figure 1:
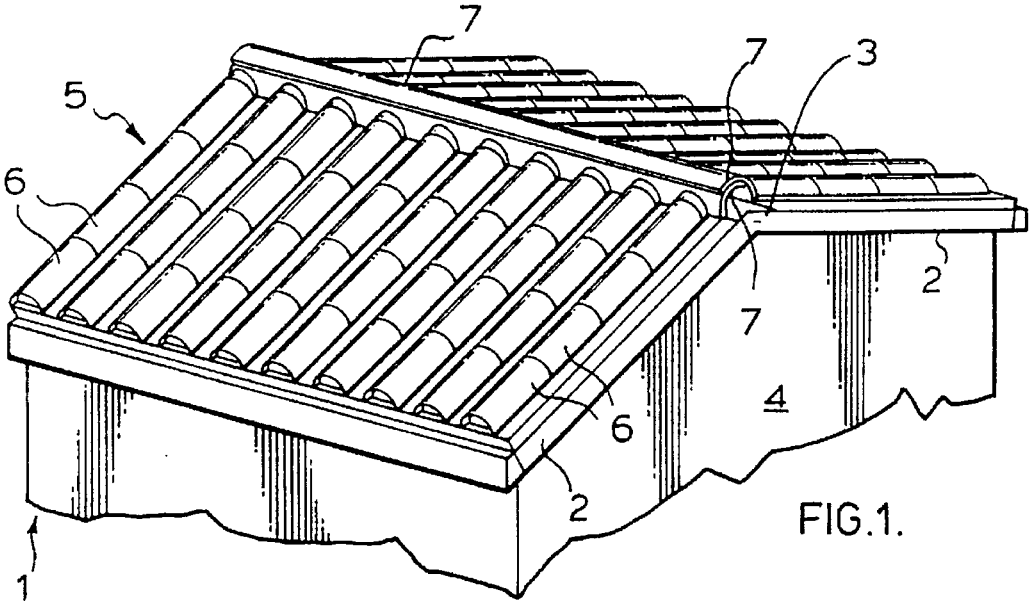
FIG. 1 is a diagrammatic view of a house having a roof cladding applied thereto in accordance with the invention, the cladding being in the form of a simulated Spanish Tile roof.

With reference to FIG. 1, a house 1 having sloping roof portions 2 rising to a ridge 3 to define a gable 4 is provided with a roof tile cladding generally designated at 5 assembled from roof tile panels secured to the roof by adapter members in accordance with the invention.

The invention is particularly applicable to the cladding of modular houses or buildings erected from interlocking extruded thermoplastic panels, box connectors and other extruded structural components and members such as referred to above as forming the subject matter of my copending application Ser. No. 08/338,605.

As illustrated in FIG. 1, the assembled roof panels present a row of simulated roof files general designated at 6 overlapping end to end and running up the slope of the roof and roof ridge tile formations generally designated at 7 extending in end-to-end relation along the ridge of the roof with the ridge tile formations on opposite sides of the ridge overlapping to close over the ridge and present a tile formation running longitudinally of the ridge.

Figure 2:
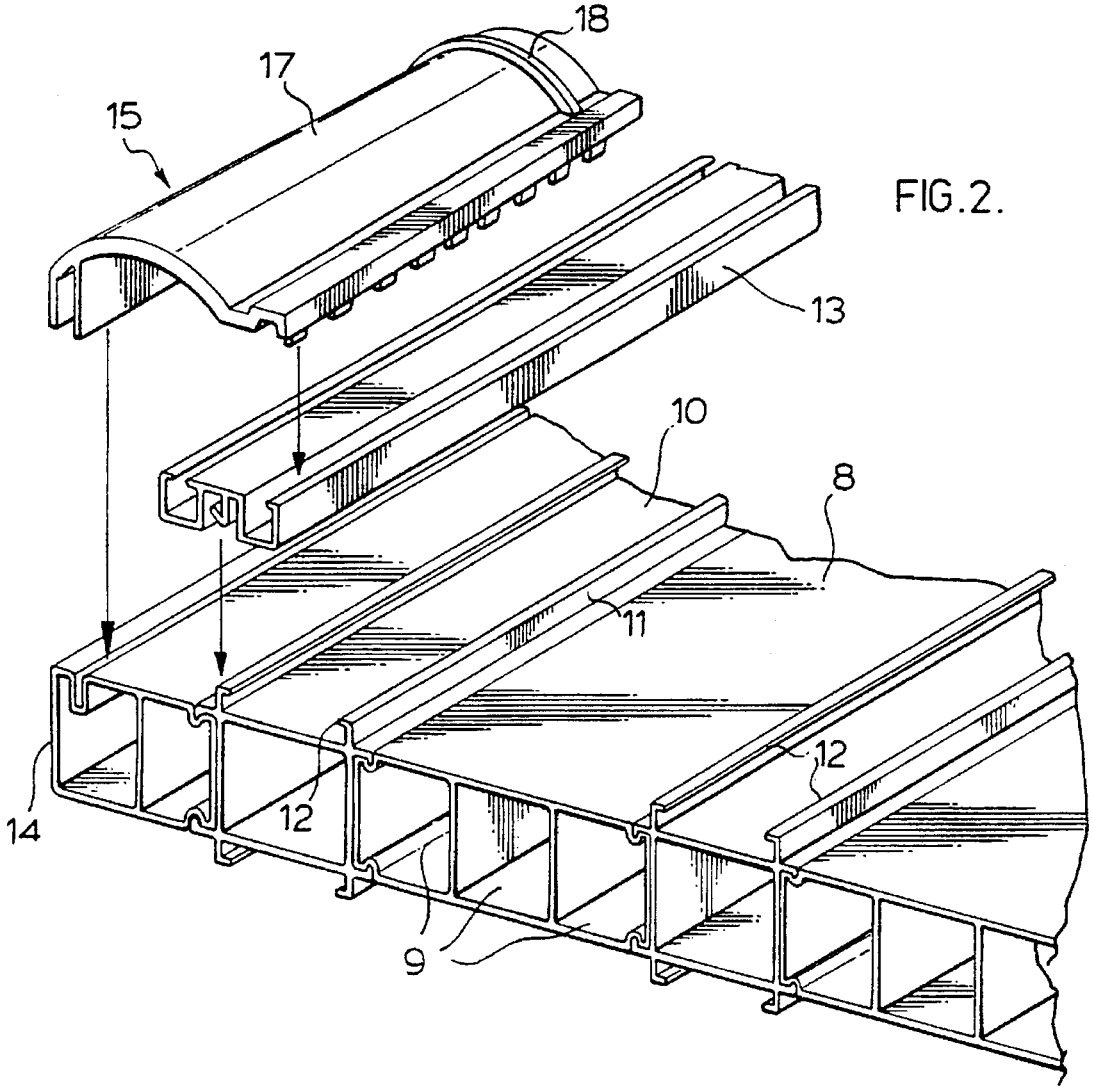
FIG. 2 is an exploded perspective view illustrating the manner in which an individual tile panel is secured by an adapter to a roof structure formed from extruded thermoplastic components in accordance with my copending application Ser. No. 08/338,605.

While the cladding of the present invention could be used to clad any roof or other surface, it will be described with reference to its particular applicability to clad the roof structure as shown in FIG. 2.

In this connection, it will be seen that the roof 2 is formed of extruded thermoplastic panels 8 shown with three internal cells 9 connected by extruded box connectors 10 provided with projecting flanges 11 having inturned fingers or ledges 12 for interlocking in end grooves in the panels 8.

The box connectors 10 illustrated comprise 4-way box connectors having the projected flanges and inturned fingers extending from all four sides thereof with the arrangement at the bottom being available for interlocking connection with a panel member or the like beneath the roof if desired, but a 3-way box connector could be used.

The provision of the flange and finger arrangement of the box connector on the upper side of the roof 2, however, provides the means of interlockingly securing an extruded roof panel adapter 13 which constitutes a keeper for retaining and locking the roof tile panels to the underlying roof as hereinafter more fully described.

In FIG. 2 the edge of the roof 2 terminates in an extruded roof panel 14 adapted to interlock with the adjacent box connector 10 and provided with means for interengagement with an injection molded edge roof tile panel 15 which simulates a single tile formation.

Figure 3:
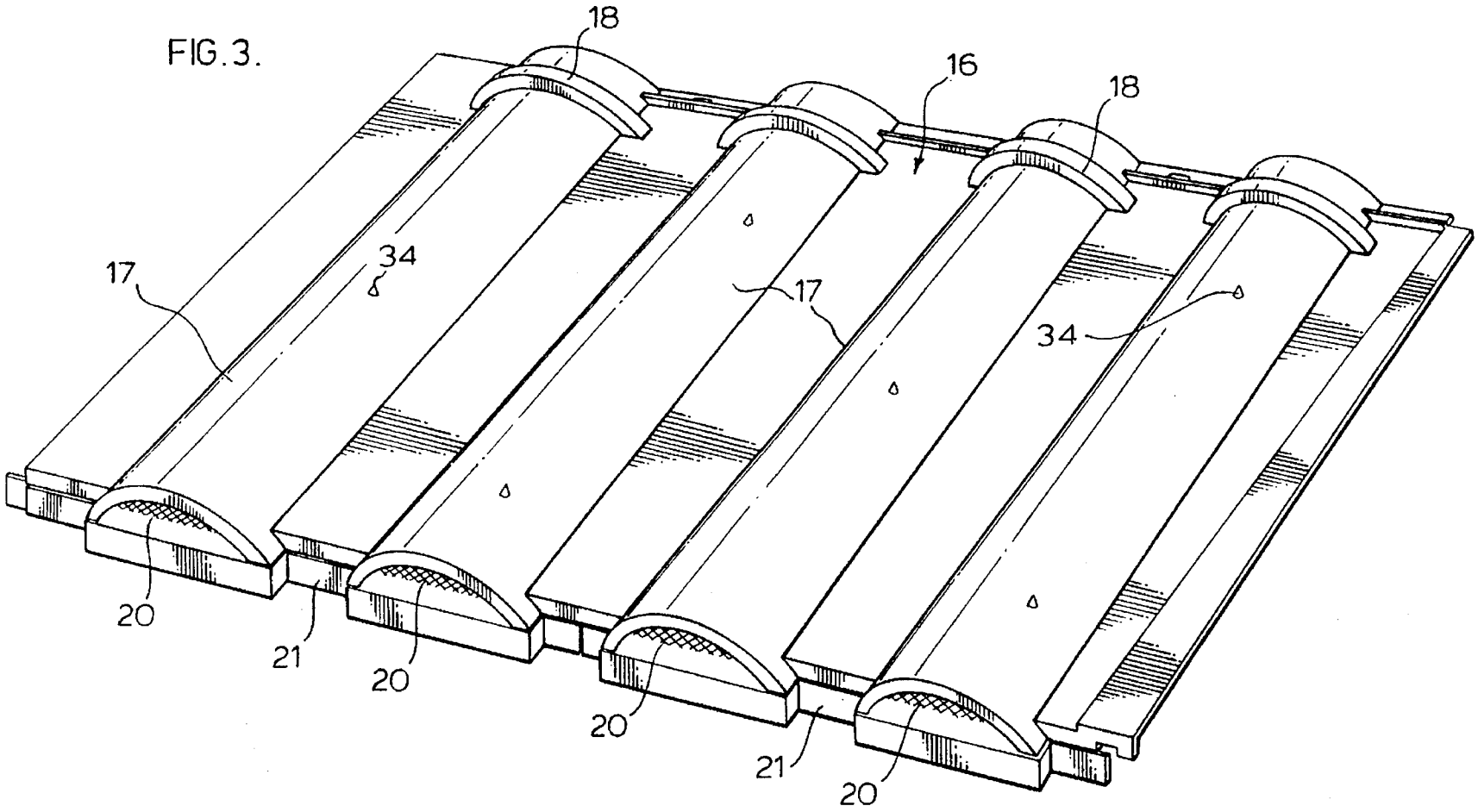
FIG. 3 is a perspective view of a panel incorporating 4 simulated tile formations together with starter strips assembled therewith providing screening at the entrance thereto.

FIG. 3 illustrates a main roof tile panel 16 simulating a row of tile configurations.

In both the roof tile panel 15 and the roof tile panel 16, the tile formations are defined by arched surfaces 17 provided at one end which is to form the upper end going up the roof slope with projecting arched ribs 18 with the height of the arched surfaces 17 decreasing towards the ribbed end.

Figure 8:
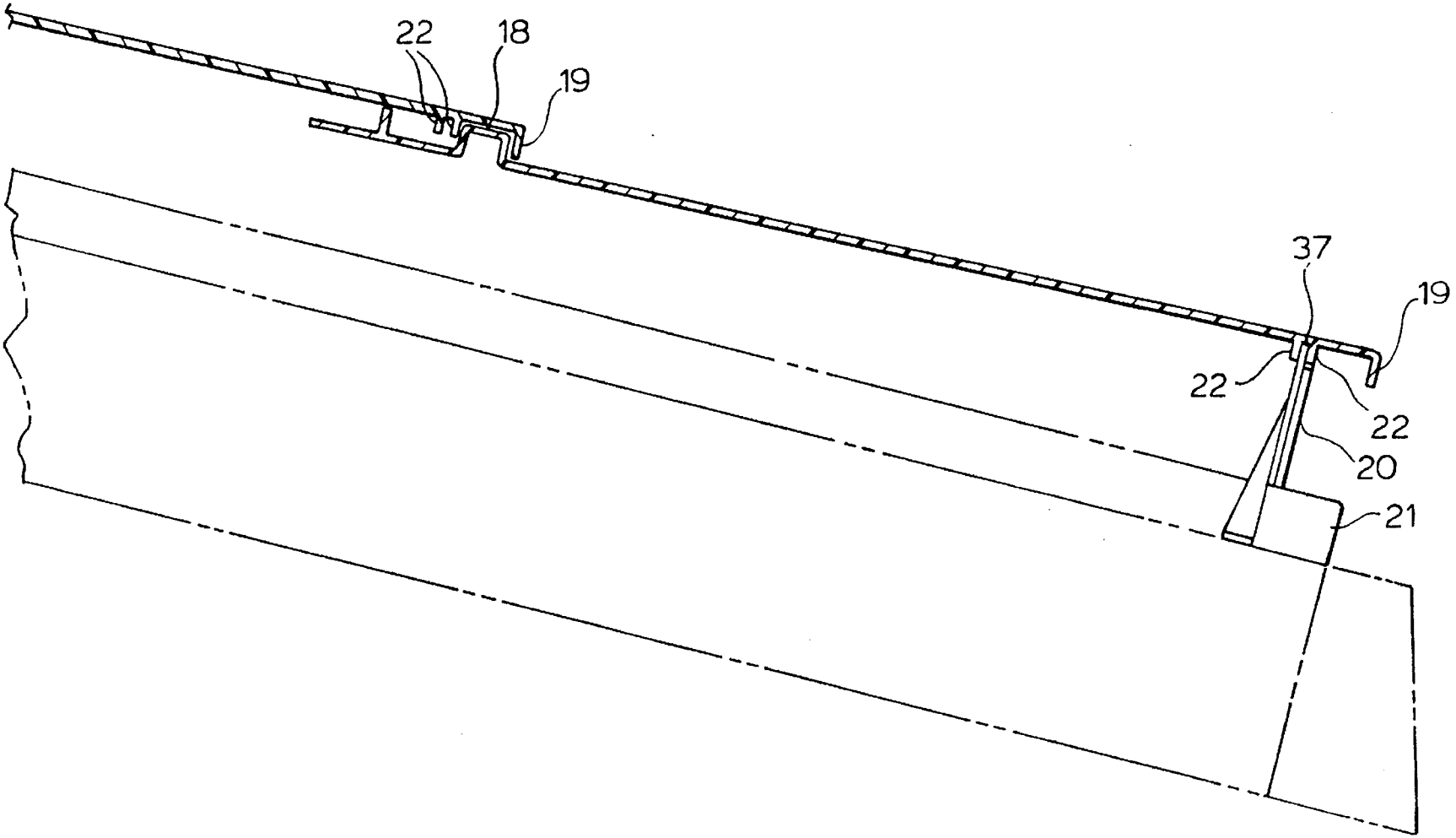
FIG. 8 is a part diagrammatic part longitudinal view illustrating the tile interfit as the tile panels are arranged in end-to-end relation up the slope of the roof and illustrating the interfit between the tile panel and the starter strip at the entrance to the roofing tiles at the edge of the roof.

At the lower end the tile formations are provided with a flange 19 for overlying and receiving the arched rib 18 of a tile formation of a preceding tile panel as shown in FIG. 8.

Figure 11:
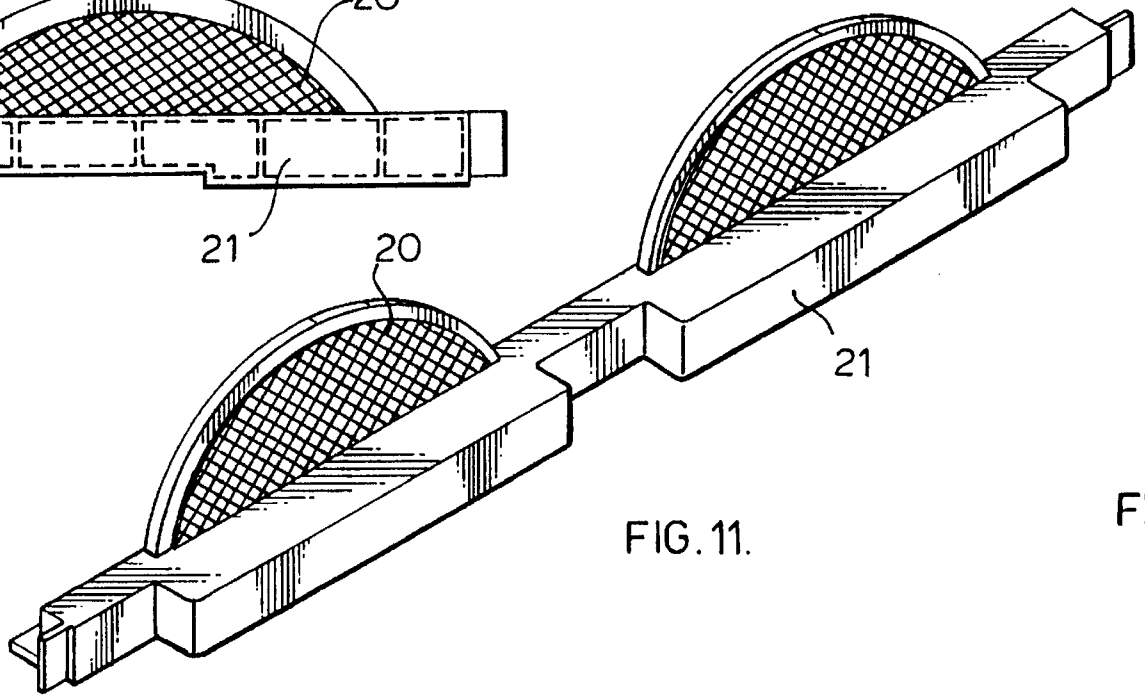
FIG. 11 is a perspective view of a starter strip to cover the entrance of two adjoining tile formations of a tile panel having a multiple of tile formations such as the tile panels of FIGS. 3 and 4.

As illustrated in FIG. 3, the end of the tile formations defined by the arched surfaces 17 are closed by screens 20 carried by starter strips 21 as illustrated in FIG. 11 and interlocked within the arched tile formations between ribs 22 as illustrated in FIG. 8.

Figure 4:
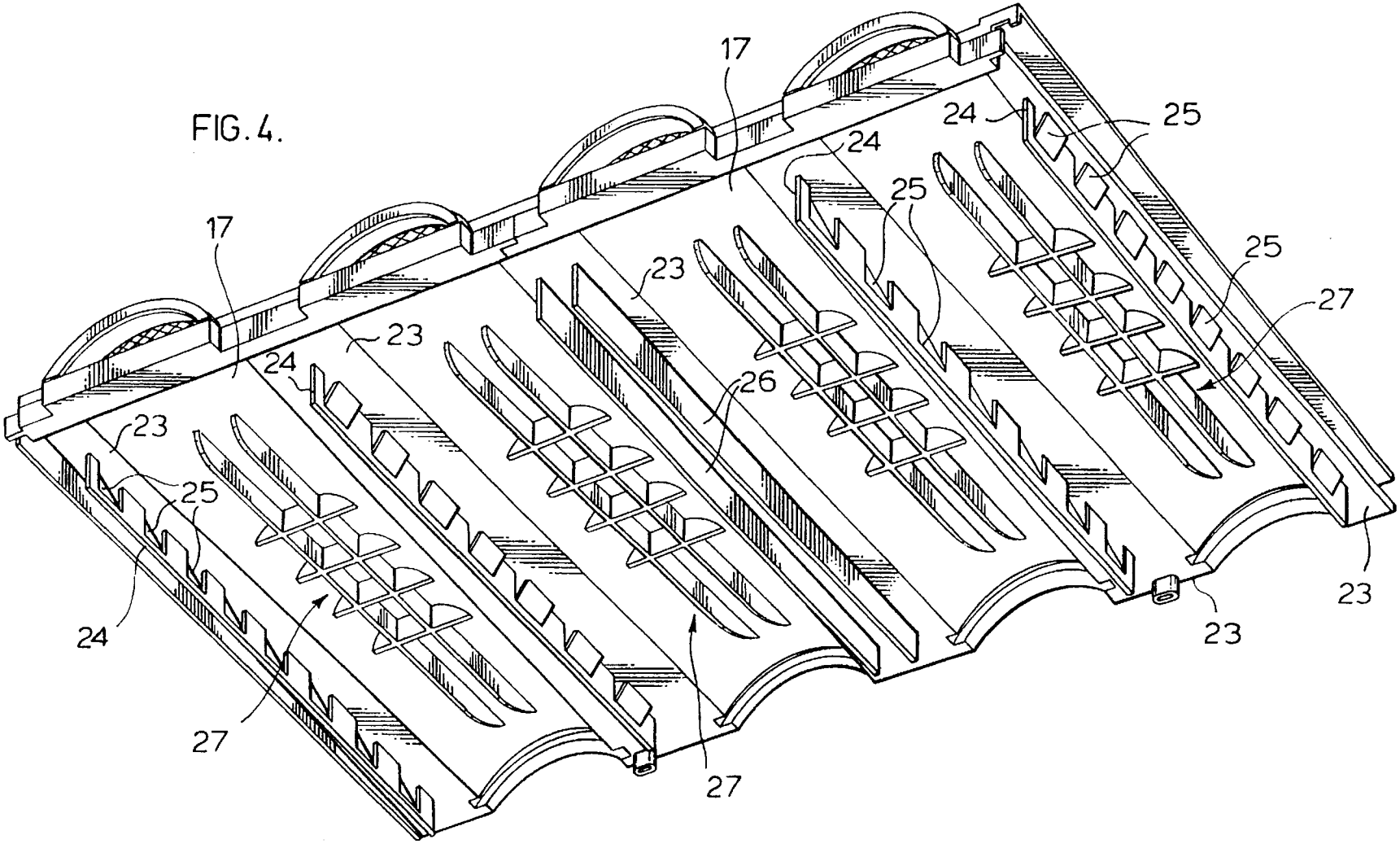
FIG. 4 is a perspective view of the underside of the tile panel and starter strips of FIG. 3 and illustrating the integral latching mechanism for snap locking with a roof mounted adapter.

As shown in FIG. 4, the arched surfaces 17 bridge over spaced bearing surfaces 23.

As illustrated in FIG. 4, the two outer bearing surfaces 23 on the opposite sides of the center bearing surface are formed with downwardly projecting flanges, tongues or wings 24 which have spaced upwardly and outwardly inclined locking barbs 25 to provide a snap interlock with the extruded adapter 13, the barbs being adapted to be resiliently flexed inwardly on entering the adapter and to thereafter spring outwardly to lock beneath the overlying surfaces.

Central flanges 26 extending downwardly from the center of the panel 16 may be arranged to either be received within the adapter 13 as guides or may bear on the roof panels 8 to give central support to the tile panel.

The underside of the roof panels preferably are formed with a reinforcing ribbing arrangement 27 as illustrated in FIG. 4 for panel 16.

The roof tile adapter 13 comprises a longitudinal extrusion which may, for instance, be extruded from PVC has, as shown particularly in FIGS. 5 and 6, a central downwardly facing channel 28 within which is a downwardly projecting straight rib 29 and spaced therefrom a rib having a downwardly projecting portion 30 and an upwardly inclined portion 31 inclined towards the rib 29.

Outwardly of the central downwardly facing channel 28 are two upwardly facing channels 32 having ledge projections 33 partially closing the entrance to the channels.

As illustrated in FIG. 6, the adapter 13 is slidably interlockable with the box connector 10 with the inturned finger or ledge of the box connector at one side being received between ribs 29 and 30 and with its ledge 12 interlocked behind the end of the upwardly inclined rib portion 31.

It will be understood that with this arrangement the adapter 13 may only be interlocked in one way with the box connector as shown and will not interlock with the flange and ledge of the box connector shown at the fight in FIG. 6 with the ledge facing in the opposite direction to that in the locking connection.

It will be understood that the tile panels can be secured to the adapters 13 by forcing the barbed ends of the tongues or flanges 24 downwardly with the locking barbs 25 being deflected inwardly in passing through the entrance to the selected upwardly facing channel 32 and thereafter resiliently snapping outwardly beneath the respective ledge projection 33'.

Figure 7:
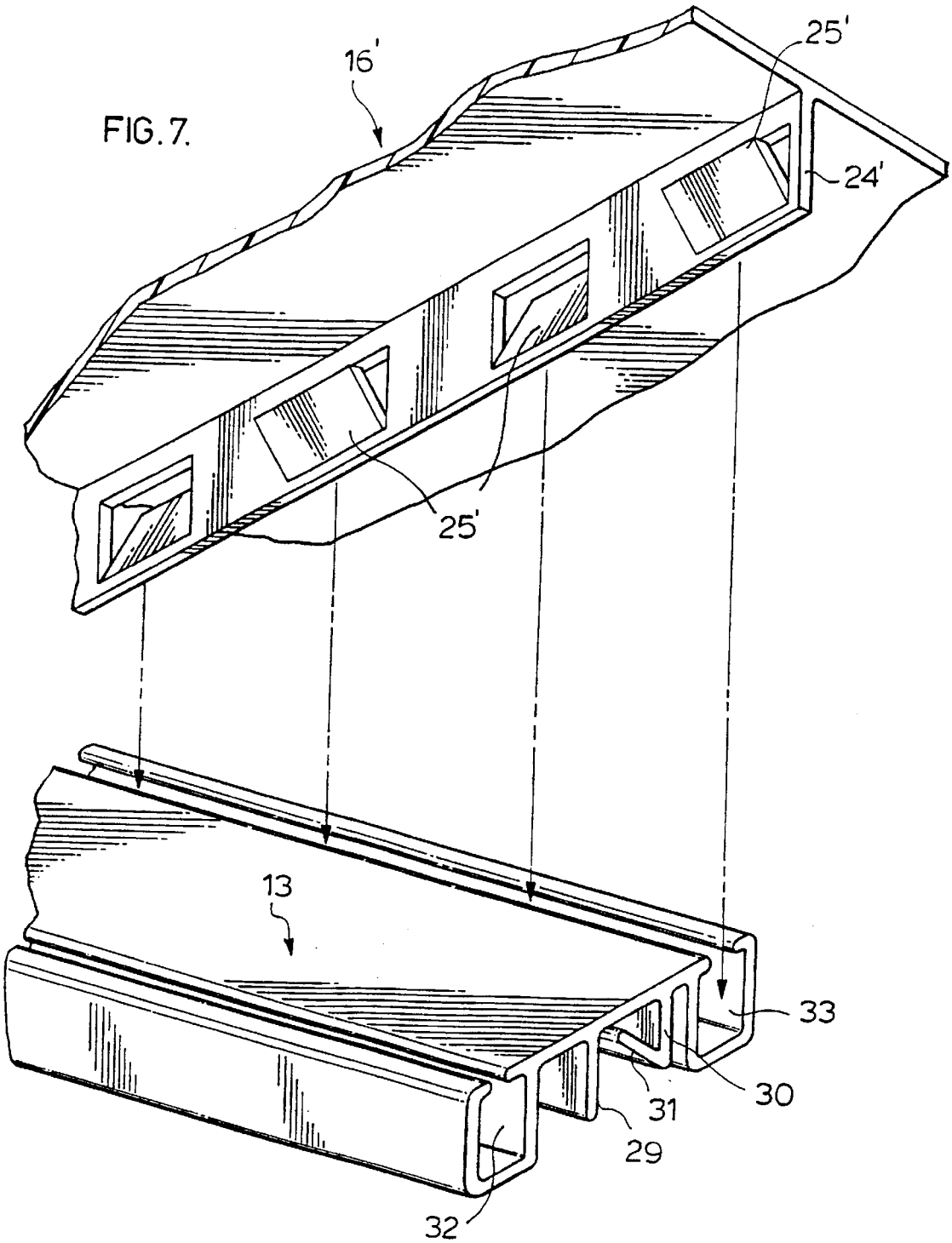
FIG. 7 is an enlarged exploded broken away perspective view showing a modified form of latching arrangement at the underside of a tile panel for snap locking into a keeper channel in the adapter illustrated in FIG. 5.

FIG. 4 illustrates the barbs 25 projecting from the same side of their carrying flange or tongue 24. FIG. 7 illustrates an alternative arrangement in which the locking barbs 25' project on opposite sides of the carrying flange or tongue 24'.

It will be understood that the roof cladding by the panelling of the present invention is intended not only to provide a decorative appearance but to provide protection for the underlying roof against the elements.

In this connection, the panels are injection molded using thermoplastic materials which will withstand the heat of the sun without deforming. A suitable thermoplastic for this purpose is available from G.E. Plastics sold under the trade-mark "NOREL". Further the cladding panels, according to the invention, may be coated with an ultraviolet resisting coating or paint as a protective measure.

For the other extreme, the outer surfaces of the panels may be provided with small projections or nibs 34 as shown in FIG. 3 to prevent ice or other materials sliding off en masse.

Figure 10:
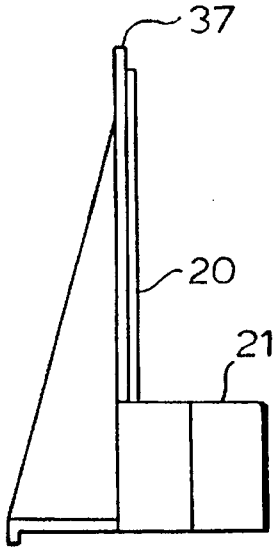
FIG. 10 is an edge elevation of the starter strip of FIG. 9.
Figure 9:
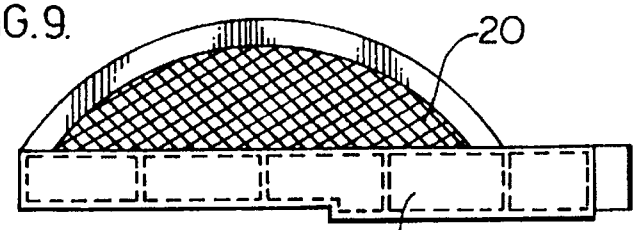
FIG. 9 is a front elevational view of a starter strip for a single tile.

FIG. 9 shows a start, or snip for closing the lower end of the lower most single tile panel 15 comprising a base 21 and an arched screen 20 which as seen from FIG. 10 presents an arched projecting rib portion 37 which interlocks into the rib arrangement 27 in the interior of the panel as illustrated in FIG. 8.

FIG. 11 illustrates a similar starter strip for use with the main panel 16 which requires the use of two such starter snips in end-to-end relation to close the entrances of the four tile formations.

Figure 12:
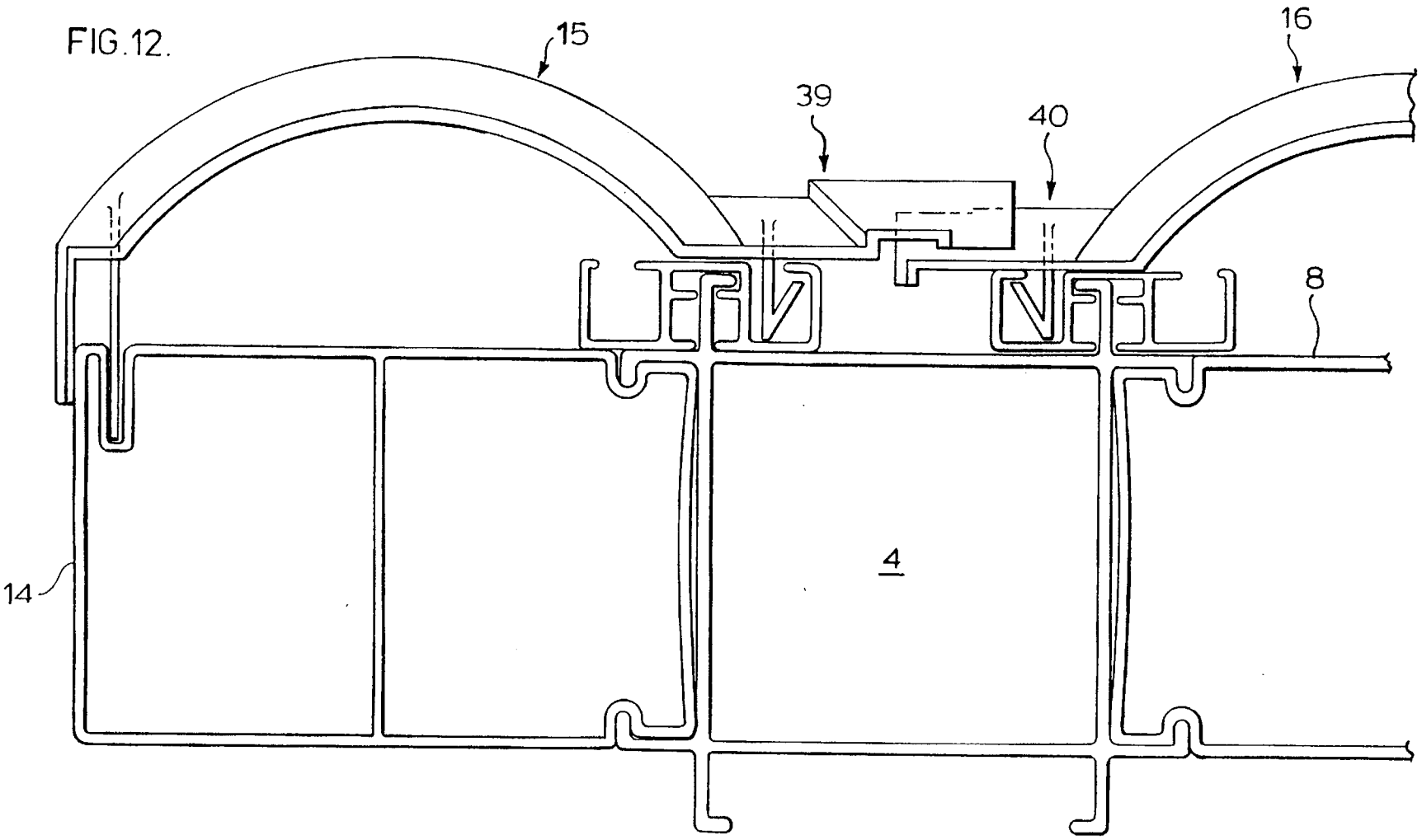
FIG. 12 is an elevational view illustrating how adjoining rows of tiles going up the roof are arranged to overlap and showing a slightly modified form of roof panel adapter.

FIG. 12 shows how the adjoining roof tile panels 15 and 16 overlap to protect the underlying roof surface.

As illustrated, panel 15 has a laterally extending wing 39 shard to overlap and interfit with the laterally extending wing 40 of the tile panel 16.

Similar overlaps are provided between adjoining main panels.

Figure 13:
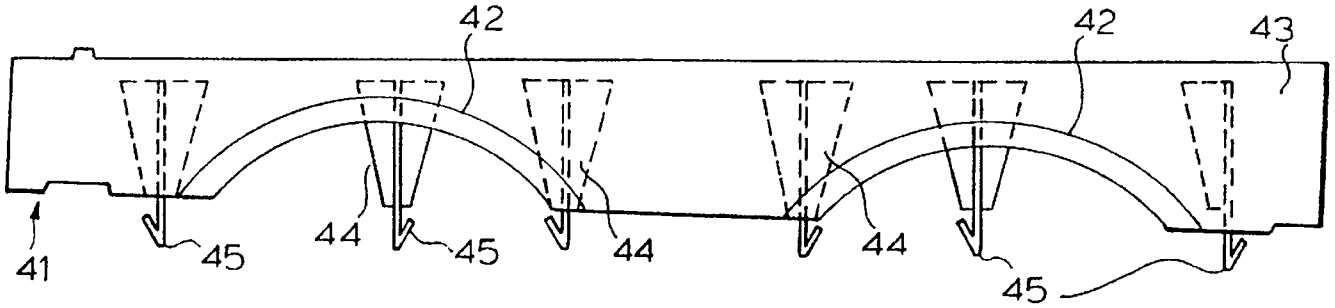
FIG. 13 is a front elevational view of a ridge vent tile.

FIG. 13 is a front elevational view of a ridge vent tile panel for interfitting with the panel 16 and bridging in part across the ridge of the roof.

This tile panel 41 is provided with arched tile surfaces 42 adapted to fit over and engage with the arched ribs of the uppermost roof tile 16 and is provided with an arched tile surface 43 having its axis extending longitudinally of the panel 41 and perpendicular to the axis of the arched surfaces 42.

Figure 14:
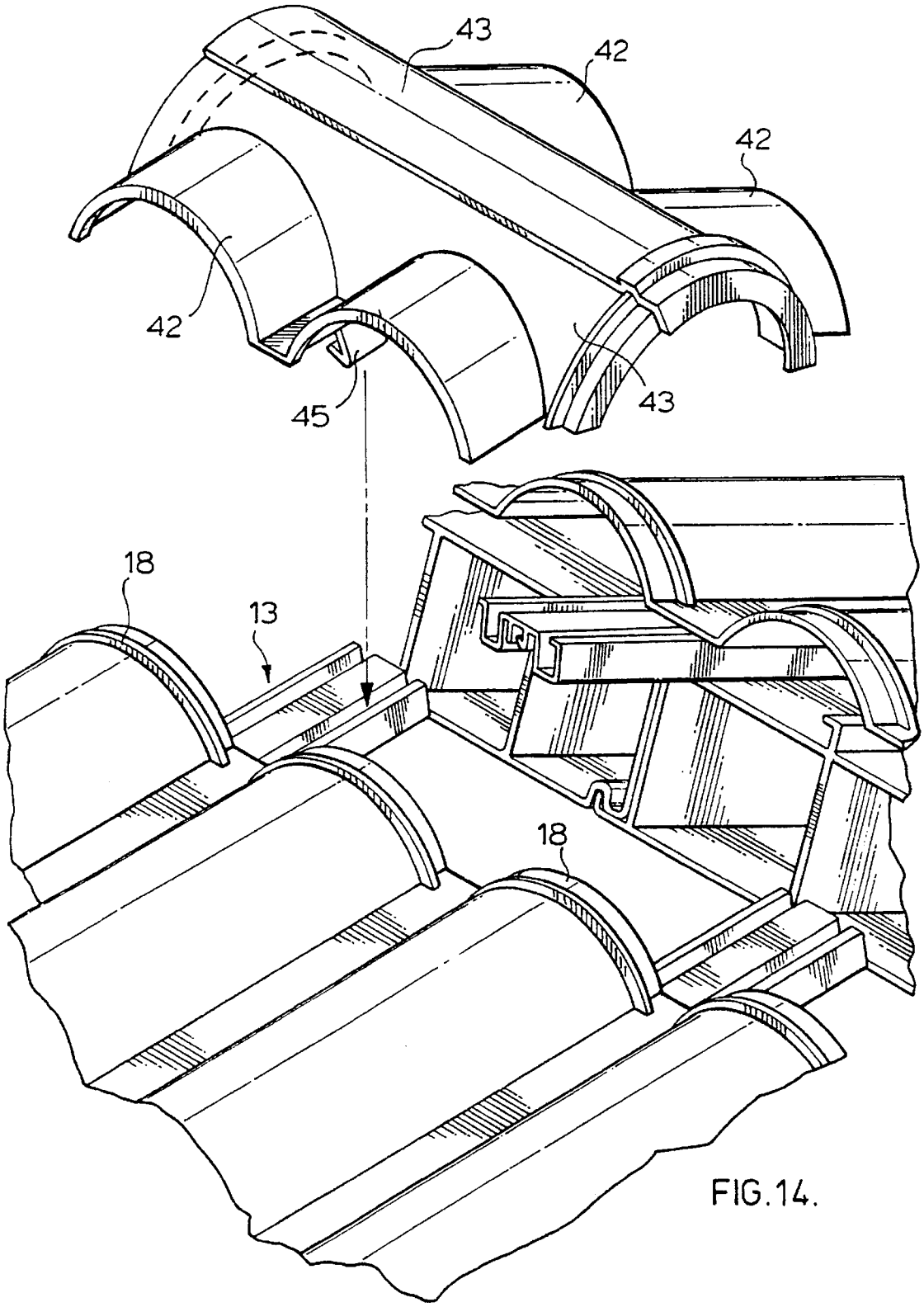
FIG. 14 is an exploded perspective view illustrating the manner in which the ridge vent tiles are adapted to overlap and to be assembled with the panels applied up the roof and with the roof panel adapters.

Tile panel 41 is formed with downwardly projecting tongues or wings 44 supporting depending locking barbs 45 adapted to interlock in the keeper channels 32 of the adapters 13 as illustrated in FIG. 14.

Figure 16:
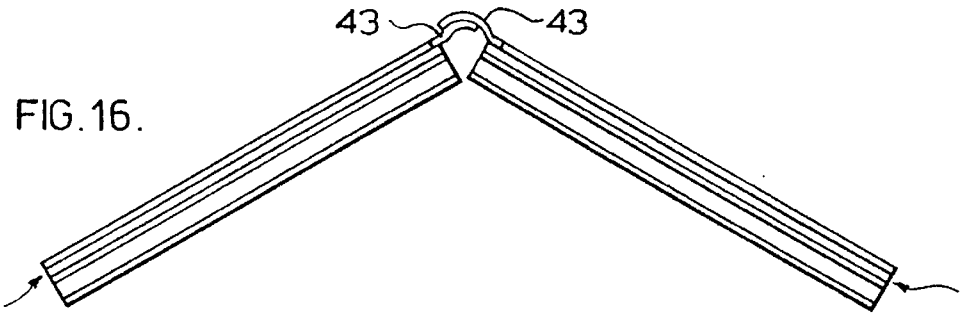
FIG. 16 is a diagrammatic view illustrating the air flow passages provided up the roof and across the roof ridge by the arched tile formations of the tile panels and showing one particular roof slope.
Figure 17:
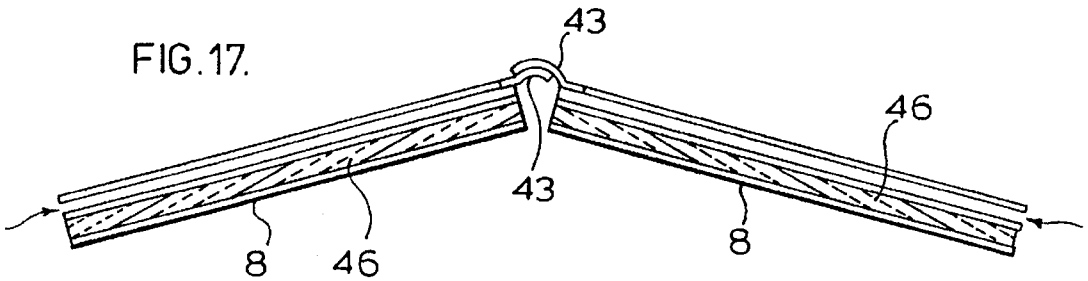
FIG. 17 is a view similar to FIG. 16 but showing a different roof slope and showing how the roof vent tiles accommodate such different roof slope and showing the roof panels filled with insulation.
Figure 15:
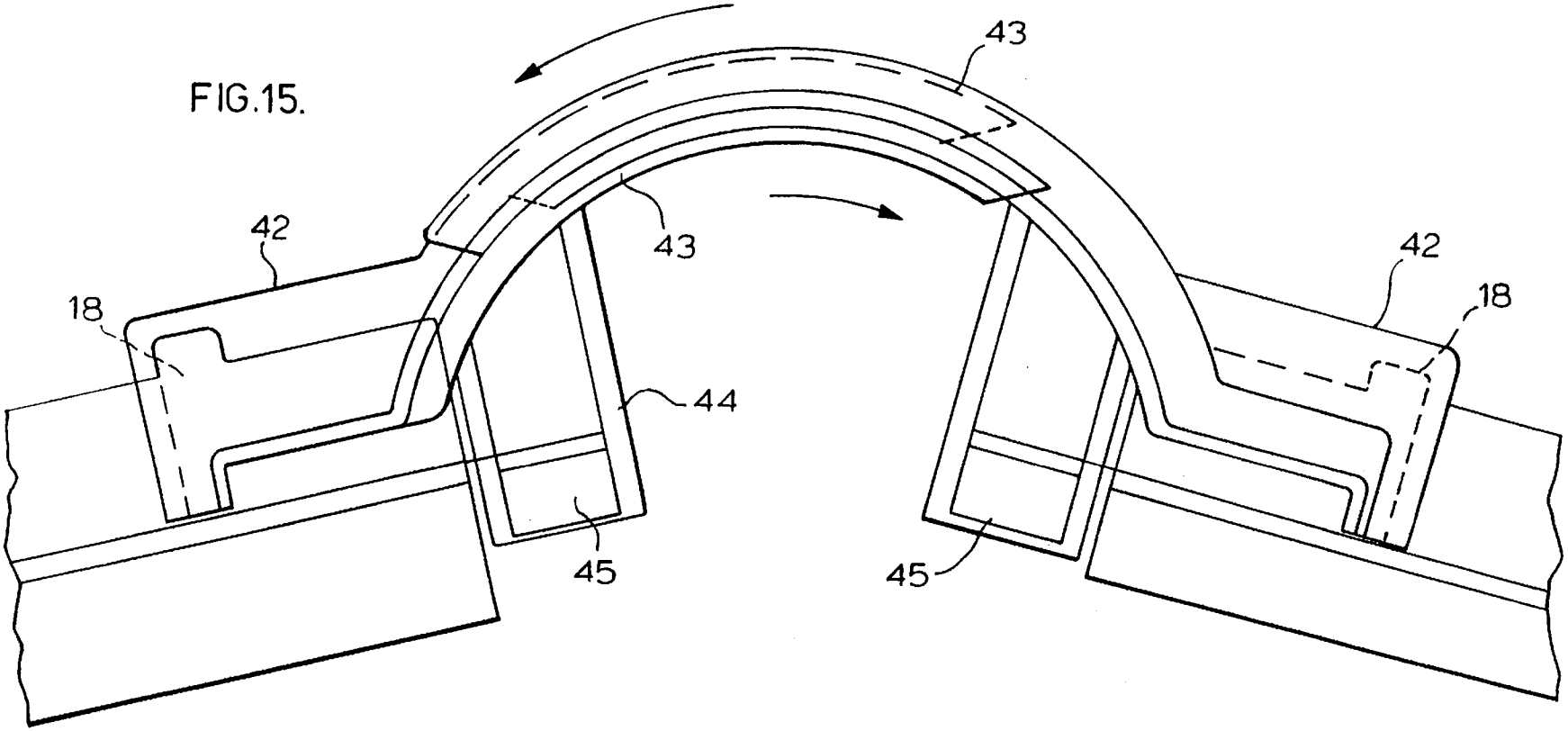
FIG. 15 is an end elevational view of the overlapped roof ridge tiles.

As will be seen from FIG. 14 opposing ridge vent panels 41 are adapted to overlap and close the ridge of the roof, the arrangement permitting the tiles 41 to be used with roofs of different slopes as illustrated in FIGS. 15, 16 and 17.

It will be understood, however, that the opposing roof tiles 41 illustrated in FIG. 14 may be formed as a single roof tile having a continuous arch over the ridge of the roof. Such tiles would fit roofs of predetermined slopes and would be configured to match the particular slope of the roof to be covered.

In addition to the protection afforded by the roof tiles or cladding itself, as illustrated in FIG. 16, the raised or arched portions of the tile formations provide air passages for the circulation of air between the tiles and the roof panels and along the ridge of the roof to afford added protection of the ridge panels. Also as illustrated in FIG. 17, the root panels themselves may be filled with insulation 46 or other inserts as desired.

While the invention has been particularly described with reference to cladding used for roofing and, in particular, roof tile cladding, it will be understood that the invention is applicable to other forms of cladding and to other surfaces.

For example, the adapter extrusion 13 can be secured to any roof or any surface and injection molded panels configured to represent the desired protective or ascetic surface can be secured thereto by snapping the barbed latches into the adapter keeper channels.

It will also be understood that variations in the detail may be made without departing from the scope of the appended claims.

The embodiments of the invention in which an exclusive property or privilege is claimed are defined as follows:

1. A molded cladding panel having a profiled outer surface and an underside, said underside of said panel having at least one bearing surfaces and a plurality of latches for securing said panel to a surface to be clad, each of said latches comprising a depending tongue portion projecting below and substantially perpendicular to said bearing surface and having an integral barb extending upwardly of a lower end of said tongue portion at an acute angle to said tongue portion, and said barb being resiliently compressible towards said tongue portion.

2. A cladding panel as claimed in claim 1 in which said profile is formed with means for interengaging with an adjoining panel.

3. A molded panel as claimed in claim 1 characterized in that the underside thereof has spaced bearing surfaces for bearing on spaced keeper members on the surface to be clad, and said barbed tongue portions (24) extend downwardly from said bearing surfaces.

4. A molded panel as claimed in claim 3 characterized in that said panel is shaped to simulate roofing tiles.

5. A molded panel as claimed in claim 4 characterized in that has an arched wall between said spaced bearing surfaces and has a longitudinally extending wing formation extending laterally from a base of said arched wall at least on one side thereof for overlapping engagement with a laterally extending wing of a corresponding laterally adjoining panel.

6. A molded panel as claimed in claim 4 characterized in that said panel has a plurality of laterally spaced longitudinally extending arched walls and has further spaced bearing surfaces on the underside thereof provided with said barbed tongues extending downwardly therefrom.

7. A molded panel as claimed in claim 6 characterized in that said panel has applied thereto an ultraviolet resistant coating.

8. A molded panel as claimed in claim 6 characterized in that the upper surface, thereof has a plurality of spaced upwardly projecting integral nibs.

9. A molded cladding panel shaped to simulate a roofing tile, said panel having on the underside thereof at least one set of spaced substantially parallel mounting means for supporting the panel on a roof and a plurality of latches, depending from said mounting means, said latches each comprising a depending tongue portion having a integral barb extending upwardly from a lower end of said tongue portion for securing said panel to a roof, said panel having an arched wall spanning between said set of said mounting means with its axis parallel to said mounting means, and said panel further having an arched wall formation located at one end of and with its axis substantially at right angles to the aforesaid arched wall.

10. A molded panel as claimed in claim 9 in which said arched wall spanning said mounting means is provided adjacent to the end thereof opposite to said arched wall formation with an internal arcuate groove for receiving an arched rib of an adjoining panel.

11. A molded panel as claimed in claim 9 or 10 having a plurality of pairs of parallel spaced mounting means with each pair of spaced parallel mounting means having an arched wall having an axis substantially parallel thereto spanning therebetween with each of said arched walls spanning between said spaced mounting means having at one end thereof an arched wall formation having its axis substantially at right angles to the axis of the arched wall it ends.

12. A molded panel as claimed in claim 10 characterized in that said arched wall formation whose axis is substantially at right angles to said arched wall spanning said spaced mounting means is provided with an internal arcuate groove adjacent one end thereof.

13. A molded cladding panel having an outer profiled surface and having an underside, said underside having spaced parallel elongated depending tongues, each said tongue having a plurality of integral barbs spaced along a length of said tongue and extending upwardly from a lower end of said tongue at an acute angle thereto, said barbs being resiliently compressible towards said tongue and said panel having means for interengaging adjoining mating panels.

14. A molded cladding panel having an outer profiled surface and having an underside, said underside having at least one elongated bearing surface and at least one elongated depending tongue projecting below said bearing surface and substantially perpendicular thereto, said tongue having a plurality of integral barbs spaced along a length of said tongue and extending upwardly from adjacent a lower end of said tongue at an acute angle thereto, and said barbs being resiliently compressible towards said tongue.

15. A molded cladding panel as claimed in claim 14 having spaced parallel elongated bearing surfaces and spaced parallel elongated depending tongues projecting below said bearing surfaces and substantially perpendicular thereto, each said tongues having a plurality of said integral barbs spaced along the length thereof and extending upwardly from adjacent the lower end tongue at an acute angle thereto, and said barbs being resiliently compressible towards said tongue.

16. A molded cladding panel as claimed in claim 15 in which said tongues project from said bearing surfaces.

17. A molded cladding panel as claimed in claims 15 or 16 in which said outer profiled surface comprises arched walls arching between said spaced parallel bearing surfaces.

18. A molded cladding panel as claimed in claims 15 or 16 in which said tongues are planar and said integral barbs comprise material displaced out of said tongues.

19. A molded cladding panel as claimed in claim 14 having an ultra violet resistant coating applied thereto.

20. A molded cladding panel as claimed in claim 14 in which said barbs are formed by displaced tongue material.

21. A molded cladding panel as claimed in claim 14 having a plurality of spaced upwardly projecting integral nibs on the outer profiled surface thereof.

22. A tiled roof overlying a roof structure which slopes upwardly to a ridge, said tiled roof comprising a plurality of keeper members having undercut slots secured to said roof structure and extending up the slope thereof, a plurality of molded/roof panels having profiled upper surfaces and elongated bearing surfaces on an underside of said panels resting on said keeper members, said panels having elongated planar tongues depending from said elongated bearing surfaces projecting into said keepers, said planar tongues having a plurality of spaced barbs at their lower ends, and said barbs being inclined upwardly at an acute angle to said tongues to lock said tongue into said undercut slots, said panels being interfitted to provide air passages running up to the ridge and an air passage at fight angles thereto running along the ridge and means for closing the ends of said passages.

23. A tiled roof as claimed in claim 22 in which the means closing the ends of said passages comprise plastic screens.

* * * * *